US005338161A

United States Patent [19]

Eley

[11] Patent Number: 5,338,161

[45] Date of Patent: Aug. 16, 1994

[54] GEAR PUMP HAVING INTERNAL BYPASS VALVE

[75] Inventor: James M. Eley, Corinth, Miss.

[73] Assignee: Dana Corporation, Toledo, Ohio

[21] Appl. No.: 717,395

[22] Filed: Jun. 19, 1991

[51] Int. Cl.[5] ..... F04B 49/00

[52] U.S. Cl. ..... 417/307; 417/310

[58] Field of Search ..... 417/307, 308, 309, 310, 417/311

[56] References Cited

U.S. PATENT DOCUMENTS

| | | | |
|---|---|---|---|
| 2,739,607 | 3/1956 | Murray | 417/307 |
| 3,182,596 | 5/1965 | Prijatel . | |
| 3,935,917 | 2/1976 | Eley et al. | 180/53 R |
| 4,100,740 | 7/1978 | Stewart | 60/431 |
| 4,470,764 | 9/1984 | Anderson et al. | 417/299 |
| 4,470,766 | 9/1984 | Masica et al. | 417/299 |
| 4,681,517 | 7/1987 | Schulz et al. | 417/310 |
| 4,746,276 | 5/1988 | McBurnett et al. | 417/295 |

*Primary Examiner*—Richard A. Bertsch
*Assistant Examiner*—Alfred Basichas
*Attorney, Agent, or Firm*—MacMillan, Sobanski & Todd

[57] ABSTRACT

A continuously driven gear pump includes an internal bypass valve for selectively controlling the supply of pressurized fluid to a hydraulically actuated device. The internal bypass valve includes a movable spool which is spring-biased to a first position, wherein the flow of fluid is bypassed from the outlet port back to the inlet port, and no fluid is delivered to the actuated device. The spool has an internal passageway formed therethrough which permits a relatively small amount of fluid to pass from the outlet port back to the reservoir when the gear pump is operated in the bypass mode. To replenish this small amount of fluid which is returned to the reservoir from the outlet port, the gear pump draws a corresponding small amount of fluid to the inlet port. Thus, a small amount of fluid circulates between the gear pump and the reservoir when the gear pump is operated in the bypass mode. This circulation cools the pump without causing a significant load to be placed on the engine. The spool can be moved to a second position against the urging of the spring, wherein the entire flow of fluid is directed to the actuated device.

5 Claims, 3 Drawing Sheets

GEAR PUMP HAVING INTERNAL BYPASS VALVE

BACKGROUND OF THE INVENTION

This invention relates in general to pumps for supplying pressurized fluid to hydraulically actuated devices. In particular, this invention relates to a continuously driven gear pump having an internal bypass valve for directing the flow of pressurized fluid from its outlet port either to the actuated device (when the gear pump is operated in the active mode) or back to its inlet port (when the gear pump is operated in the bypass mode), thereby selectively controlling the operation of the device. This invention also relates to a means for cooling the gear pump when it is operated in the bypass mode.

Gear pumps are well known structures which typically include a pair of gears mounted upon respective shafts for rotation within a pump housing. The shafts are arranged such that the gears mesh within a pumping chamber disposed between an inlet port and an outlet port of the gear pump. One of the shafts is rotated by an external source of power so as to cause the two gears to rotate. The cooperation of the gears with the pumping chamber causes fluid to be drawn from a reservoir through the inlet port and be discharged from the outlet port to the hydraulically actuated device. The device is responsive to the pressurized fluid from the gear pump for being actuated in a known manner.

One common use for gear pumps is on refuse collection vehicles having one or more hydraulically actuating packing devices. The gear pump is usually connected to and driven by the internal combustion engine of the vehicle so as to selectively generate a flow of pressurized fluid to operate the packing devices. Because of its size and reliability, the gear pump is well suited to perform this function. Typically, however, such packing devices are used only intermittently, requiring no flow of pressurized fluid for long periods of time, while the internal combustion engine is usually continuously operated. Thus, for this and other gear pump applications, some means must be provided for selectively interrupting the flow of pressurized fluid from the gear pump to the hydraulic device.

Several structures are known in the art for accomplishing this selective interruption of fluid flow from the gear pump to the actuated device. A first known structure includes an external bypass valve connected between the outlet port of the gear pump (which is continuously driven by the engine) and the actuated device. The external bypass valve is controlled by an operator to selectively direct the flow of pressurized fluid from the outlet port of the gear pump either to the device or back to the reservoir. Thus, when the device is not to be operated, the flow of pressurized fluid is directed from the outlet port of the gear pump back to the reservoir, bypassing the device. Unfortunately, this structure results in undesirable power losses, particularly at high engine speeds, because fluid is continuously pumped a relatively long distance from the reservoir to the pump and back to the reservoir.

A second known structure includes a power take-off unit or a clutch connected between the engine and the gear pump. The power take-off unit or clutch selectively makes and breaks the rotational driving connection between the internal combustion engine and the gear pump. When the device is not to be operated, the power take-off or clutch is disengaged so as to disable the gear pump. As a result, the flow of pressurized fluid to the device is interrupted. While such structures are efficient because they do not impose any load on the engine when the device is not in use, they are typically expensive, complicated, and prone to failure.

A third known structure includes a dry valve, which can simply be described as a shut-off valve disposed in the inlet port of the gear pump. When closed, the dry valve obstructs the flow of fluid from the inlet port into the pumping chamber of the gear pump. Consequently, the flow of pressurized fluid to the device is interrupted, even though the gear pump is continuously driven by the engine. Typically, means are provided in the dry valve for permitting a relatively small amount of fluid to flow into the pumping chamber even when the dry valve is closed. Such relatively small amount of fluid flow is necessary for lubricating and cooling the components of the gear pump while it is operated in the dry mode. However, means must also be provided for preventing this small amount of fluid from being pumped to the device and inadvertently actuating same when the gear pump is operated in the dry mode. Such means can include a flow control valve disposed in the outlet port of the pump for diverting the small amount of fluid back to the reservoir.

SUMMARY OF THE INVENTION

This invention relates to an improved structure for a continuously driven gear pump which includes an internal bypass valve for selectively controlling the supply of pressurized fluid to a hydraulically actuated device. The gear pump includes a pair of gears mounted upon respective shafts for rotation within a pump housing. The shafts are arranged such that the gears mesh within a pumping chamber disposed between an inlet port and an outlet port of the pump. One of the shafts is continuously rotated by an external power source so as to cause the two gears to rotate. The cooperation of the gears with the pumping chamber causes fluid to be drawn from a reservoir through the inlet port and be discharged from the outlet port to the hydraulically actuated device. The internal bypass valve is provided within the gear pump housing for selectively directing the flow of pressurized fluid from the outlet port either to the actuated device (when the gear pump is operated in the active mode) or back to the inlet port (when the gear pump is operated in the bypass mode). In this manner, the operation of the hydraulically actuated device is controlled.

The internal bypass valve includes a movable spool which is spring-biased to a first position, wherein the flow of fluid is bypassed from the outlet port back to the inlet port, and no fluid is delivered to the actuated device. The spool has an internal passageway formed therethrough which permits a relatively small amount of fluid to pass from the outlet port back to the reservoir when the gear pump is operated in the bypass mode. To replenish this small amount of fluid which is returned to the reservoir from the outlet port, the gear pump draws a corresponding small amount of fluid to the inlet port. Thus, a small amount of fluid circulates between the gear pump and the reservoir when the gear pump is operated in the bypass mode. This circulation cools the pump without causing a significant load to be placed on the engine. The spool can be moved to a second position against the urging of the spring, wherein the entire flow of fluid is directed to the actuated device.

Various objects and advantages of this invention will become apparent to those skilled in the art from the following detailed description of the preferred embodiment, when read in light of the accompanying drawings.

DETAILED DESCRIPTION THE PREFERRED EMBODIMENT

Figure 1:
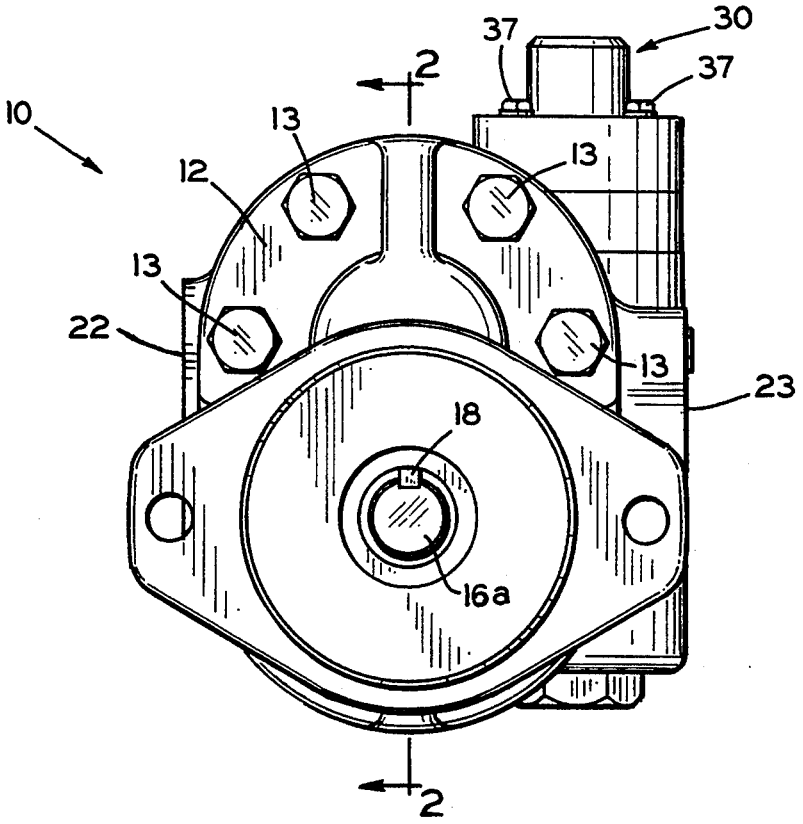
FIG. 1 is a front elevational view of a gear pump including an internal bypass valve in accordance with this invention.
Figure 2:
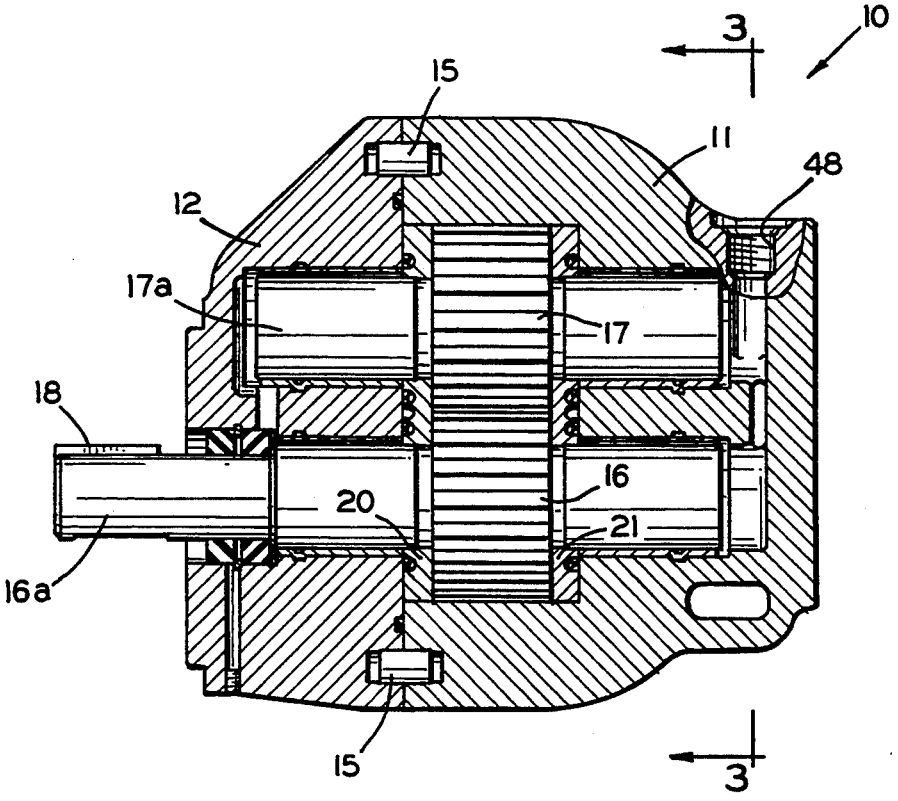
FIG. 2 is a sectional elevational view of the gear pump taken along line 2—2 of FIG. 1.

Referring now to the drawings, there is illustrated in FIGS. 1 through 4 a gear pump, indicated generally at 10, in accordance with this invention. The gear pump 10 includes a body 11 having a mounting flange 12 secured thereto by a plurality of bolts 13. A plurality of dowels 15 are provided to support and align the mounting flange 12 relative to the body 11. Within the gear pump 10, a drive gear 16 and an idler gear 17 are disposed. The gears 16 and 17 are supported on respective shafts **16*a* and 17*a* for rotation therewith. The ends of the shafts 16*a* and 17*a* are journalled for rotation in the body 11 and the mounting flange 12. One end of the shaft 16*a* carrying the drive gear 16 extends outwardly from the pump 10 and is provided with a key 18. The key 18 permits the shaft 16*a* and the drive gear 16** to be connected to a source of rotational power, such as an internal combustion engine for a vehicle (not shown).

The gears 16 and 17 mesh within a pumping chamber defined within the pump 10. A pair of pressure plates 20 and 21 are disposed on opposite sides of the gears 16 and 17. The pressure plates 20 and 21 provide a seal between the pumping chamber and the other components of the gear pump 10. The pumping chamber communicates with an inlet port 22 and an outlet port 23. The inlet port 22 communicates with a reservoir (not shown) containing a supply of low pressure fluid. As used herein, low pressure means at or near atmospheric pressure. The outlet port 23 communicates with a hydraulically actuated device (not shown) which is adapted to be actuated by the flow of high pressure fluid from the gear pump 10.

Figure 4:
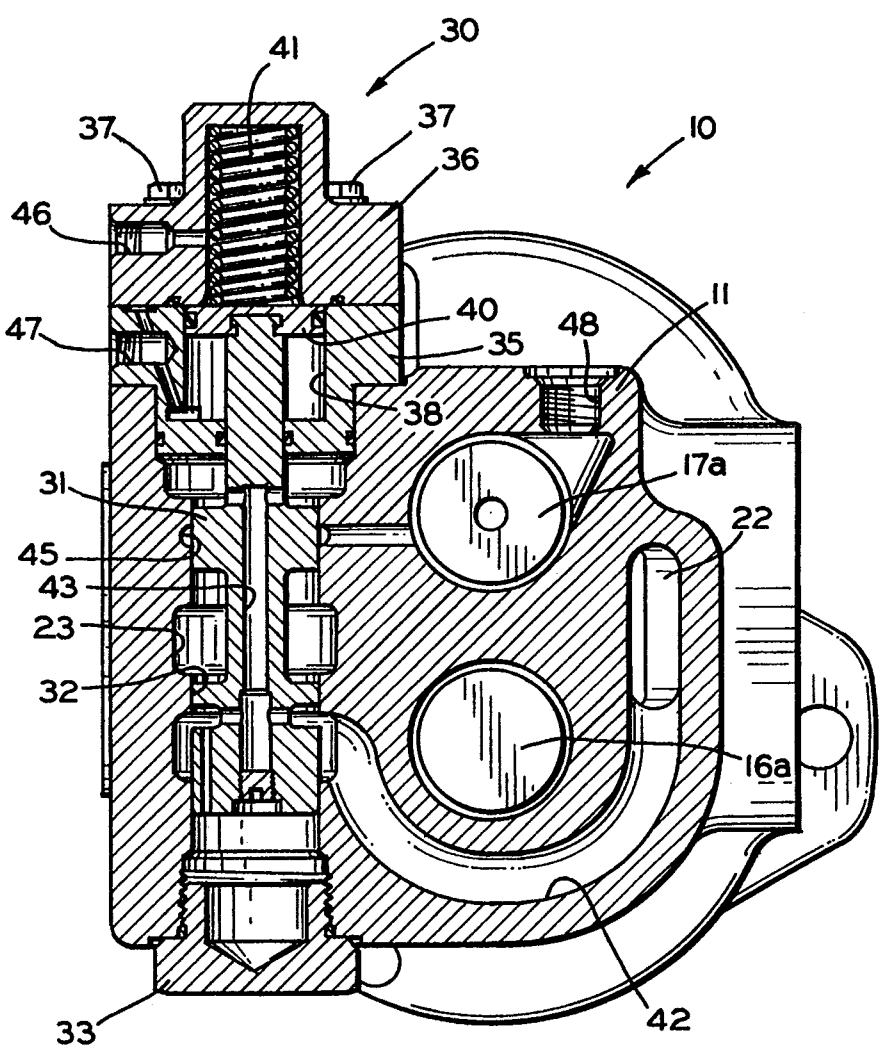
FIG. 4 is a sectional elevational view similar to FIG. 3 showing the internal bypass valve in an upward position, whereby the gear pump is operated in an active pumping mode.
Figure 3:
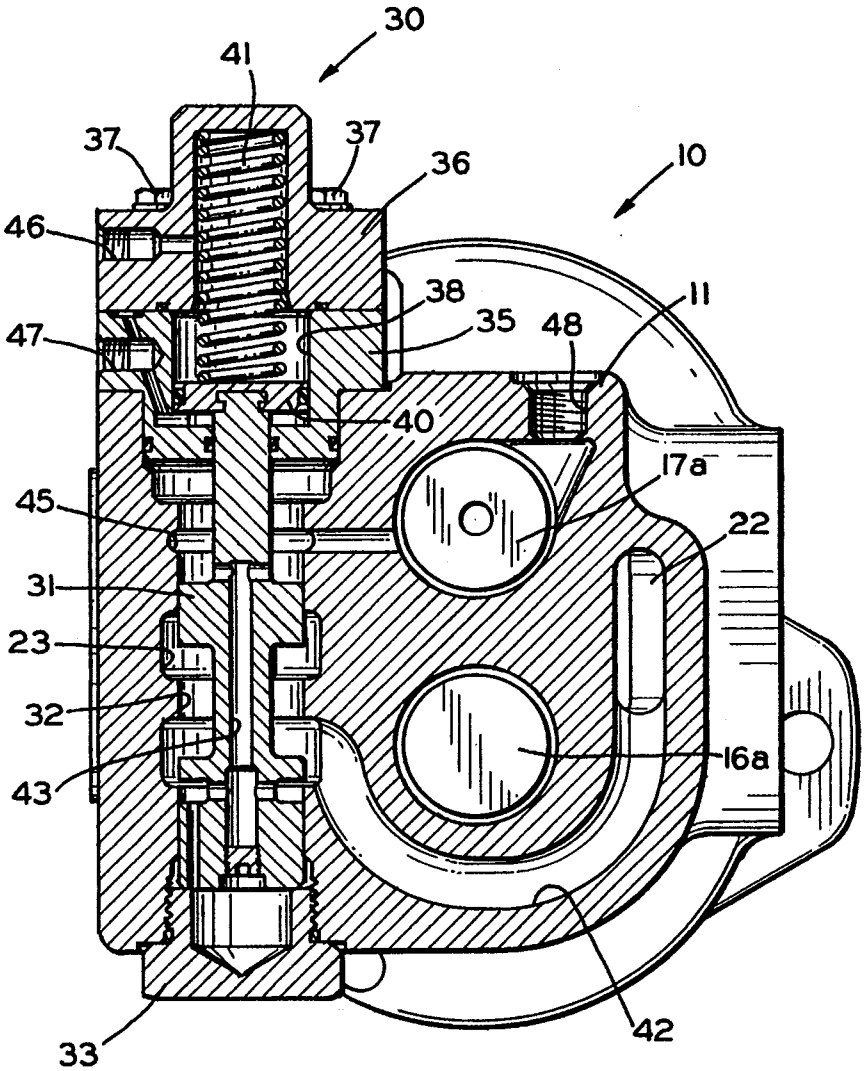
FIG. 3 is a sectional elevational view of the gear pump taken along line 3—3 of FIG. 2 showing the internal bypass valve in a downward position, whereby the gear pump is operated in a bypass mode.

When driven by the source of rotational power, the drive shaft **16*a* and the drive gear 16 are rotated in one direction (clockwise when viewing FIGS. 3 and 4), thereby causing the idler shaft 17*a* and the idler gear 17 to rotate in the opposite direction (counter-clockwise when viewing FIGS. 3 and 4). As a result, the gear pump 10 draws low pressure fluid from the reservoir through the inlet port 22 and discharges such fluid at a high pressure from the outlet port 23 to the hydraulically actuated device. The fluid is then returned from the device to the reservoir. The structure and operation of the gear pump 10** thus far described is conventional in the art.

Referring now to FIGS. 3 and 4, an internal bypass valve, indicated generally at 30, is provided within the body 11 of the pump 10. The bypass valve 30 includes a spool 31 which is slidably disposed in a flow control chamber 32 formed in the body 11. The lower end of the flow control chamber 32 is closed by a plug 33 threaded into the body 11. The upper end of the flow control chamber 32 is closed by a valve block 35 and a valve cap 36, both of which are secured to the valve body 11 by a plurality of threaded fasteners 37. An actuating chamber 38 is defined within the valve block 33 and the valve cap 36.

The upper end of the spool 31 extends through a central aperture formed through the valve block 35 into engagement with a piston head 40 disposed within the actuating chamber 38. A spring 41 is also provided within the actuating chamber 38. The spring 41 exerts a force urging the piston head 40 (and the spool 31 connected thereto) downwardly to the position illustrated in FIG. 3. However, as will be described in detail below, the piston head 40 and the spool 31 can be moved upwardly against the urging of the spring 41 from the bypass mode position shown in FIG. 3 to the active mode position shown in FIG. 4.

An arcuate bypass passageway 42 is formed in the body of the gear pump 10. The bypass passageway 42 extends from the flow control chamber 32 to the inlet port 22. When the spool 31 is in the downward position illustrated in FIG. 3 for bypass mode operation, fluid communication is permitted between the outlet port 23 and the bypass passageway 42. When the spool 31 is in the upward position illustrated in FIG. 4 for active mode operation, fluid communication is prevented between the outlet port 23 and the bypass passageway 42. The function of the bypass passageway 42 will be explained below.

The operation of the internal bypass valve 30 will now be explained in connection with the operation of the gear pump 10. As previously mentioned, the drive shaft **16*a* is connected to a source of rotational power, such as an internal combustion engine for a vehicle. Thus, the drive shaft 16*a*, the drive gear 16, the idler gear 17 and the idler shaft 17*a* are all constantly rotated so long as the vehicle engine is running. As a result, fluid is pumped from the inlet port 22 to the outlet port 23. The bypass valve 30 is controlled so as to selectively direct the flow of fluid from the outlet port 23 either to the device (in the active mode to operate the device) or to the inlet port 22 (in the bypass mode to discontinue operation of the device). This control is provided by the movement of the spool 31 between the positions illustrated in FIGS. 3 and 4**.

When the spool 31 is in the upward position shown in FIG. 4, the pump 10 is operated in the active mode. In this mode, the spool 31 is positioned such that fluid communication between the outlet port 23 and the bypass passageway 42 is prevented, as discussed above. Thus, all of the hydraulic fluid from the outlet port 23 is delivered to the device. Since the device restricts the free flow of fluid therethrough, the pressure of the fluid at the outlet port 23 is much higher than the low pressure fluid at the inlet port and the reservoir. As mentioned above, a line is provided for returning the fluid from the device to the reservoir to complete the hydraulic circuit therebetween.

When the spool 31 is in the downward position shown in FIG. 3, the gear pump 10 is operated in the bypass mode, wherein the hydraulically actuated device is not operated. In this mode, the spool 31 is positioned such that fluid communication is permitted between the outlet port 23 and the bypass passageway 42, also as discussed above. Because the actuated device functions as a restriction to the free flow of fluid therethrough, and further because the bypass passageway 42 communicates with low pressure inlet port 22 (and the reservoir connected thereto), the flow of fluid is diverted from the outlet port 23 downwardly through the flow control chamber 32 and the bypass passageway 42 to the inlet port 22. Thus, when the spool 31 is in the downward position, most of the hydraulic fluid from the outlet port 23 is returned to the inlet port 22, and no fluid is delivered to the device.

It will be appreciated that only a small amount of power is required to pump the fluid the short distance from the outlet port 23 back to the inlet port 22 when the gear pump 10 is operated in the bypass mode. This is advantageous because only a small load is placed on the engine which drives the gear pump 10 during that period of time. Thus, the gear pump 10 operates efficiently in the bypass mode. However, because some power is required, it will also be appreciated that the pressure of the fluid at the outlet port 23 is slightly higher than the pressure of the fluid at the inlet port 22 when the gear pump 10 is operated in the bypass mode, although it is much smaller than the high pressure normally present at the outlet port 23 during operation in the active mode, as described above.

If, during such bypass mode operation, all of the fluid was directed from the outlet port 23 back to the inlet port 22, undesirable heat could build up within the gear pump 10. This is because gear pumps are typically cooled by the flow of fluid being pumped therethrough. Since such fluid is drawn from the reservoir at a relatively cool temperature, heat is taken away from the pump 10 as is it operated in the active mode. However, if all of the fluid is recirculated through the gear pump 10 during bypass mode operation, then the temperature of the fluid would increase, and no heat would be carried away from the pump 10. Consequently, the increased amount of heat in the pump 10 could cause premature failure.

This invention takes advantage of the slight pressure differential discussed above between the outlet port 23 and the inlet port 22 during bypass mode operation to cause a small amount of fluid to circulate between the gear pump 10 and the reservoir and, therefore, cool the gear pump 10. To accomplish this, an internal passageway 43 is formed through a portion of the spool 31. The internal passageway 43 provides communication between the outlet port 23 and a case drain port 45 formed in the flow control chamber 32 of the valve body 11. As shown in the drawings, such communication is permitted only when the spool 31 is located in the downward position illustrated in FIG. 3. The case drain port 45 communicates with a conventional case drain 48 provided in the gear pump 10 for draining leakage therefrom for return to the reservoir.

When the pump 10 is operated in the bypass mode, the slightly higher pressure of the fluid at the outlet port 23 causes some of such fluid to flow into the internal passageway 43 of the spool 31, through the case drain port 45, and back to the reservoir. The internal passageway 43 is sized to be relatively small in comparison to the size of the bypass passageway 42. Accordingly, only a small amount of fluid passes through the internal passageway 42 and the case drain port 45 back to the reservoir when the spool 31 is in the downward position. Preferably, the internal passageway 43 is sized to permit approximately two to three gallons of fluid to flow therethrough to the reservoir each minute the gear pump 10 is operated in the bypass mode.

Because of the return of this fluid to the reservoir, the gear pump 10 draws an equal amount of fresh fluid from the reservoir to the inlet port 22 to replenish the lost volume. This fresh fluid drawn from the reservoir is relatively cool in temperature and functions to draw heat away from the gear pump 10 as it is operated in the bypass mode. As a result, the gear pump 10 is prevented from overheating. Thus, it can be seen that the internal passageway 43 provides a means for circulating a small amount of fluid between the pump 10 and the reservoir when the pump 10 is operated in the bypass mode. Because only a relatively low pressure at the outlet port 23 is required to cause this circulation, no significant load is imposed on the engine during bypass mode operation.

Means are provided for controlling the upward and downward movement of the spool 31 and, therefore, the mode of operation of the pump 10. As shown in FIGS. 3 and 4, first and second control passageways 46 and 47 are respectively formed in the valve cap 36 and the valve block 35. The first control passageway 46 communicates with the upper end of the actuating chamber 38 above the piston head 40, while the second control passageway 47 communicates with the lower end of the actuating chamber 38 below the piston head 40.

To cause the piston head 40 (and the spool 31 connected thereto) to move downwardly to the position illustrated in FIG. 3, the first and second control passageways 46 and 47 are simultaneously connected to a source of pressurized air. Since the surface area of the upper end of the piston head 40 which is exposed to the pressurized air is greater than the surface area of the lower end of the piston head 40 which is similarly exposed (because of the connection of the spool 31 thereto), the net force exerted on the piston head 40 causes it to move downwardly to the position illustrated in FIG. 3. The urging of the spring 41 also assists in such downward movement.

To cause the piston head 40 (and the spool 31 connected thereto) to move upwardly to the position illustrated in FIG. 4, the first control passageway 46 is vented to the atmosphere, while the second control passageway 47 is continued to be connected to the source of pressurized air. The upward force exerted by the pressurized air on the lower end of the piston head 40 is greater than the downward force exerted by the spring 41. Therefore, the piston head 40 is moved upwardly to the position illustrated in FIG. 4 against the urging of the spring 41.

It will be appreciated, therefore, that pressurized air is constantly supplied through the second control passageway 47 to the lower end of the piston head 40. This is done to prevent pressurized fluid in the adjacent flow control chamber 32 from seeping upwardly into the actuating chamber 38. The spring 41 is provided to move the piston head 40 to the downward position illustrated in FIG. 3 in the event of a complete failure of the source of pressurized air. In this event, it is desirable that the gear pump 10 be automatically placed in the bypass mode to prevent operation of the hydraulically actuated device.

Figure 5:
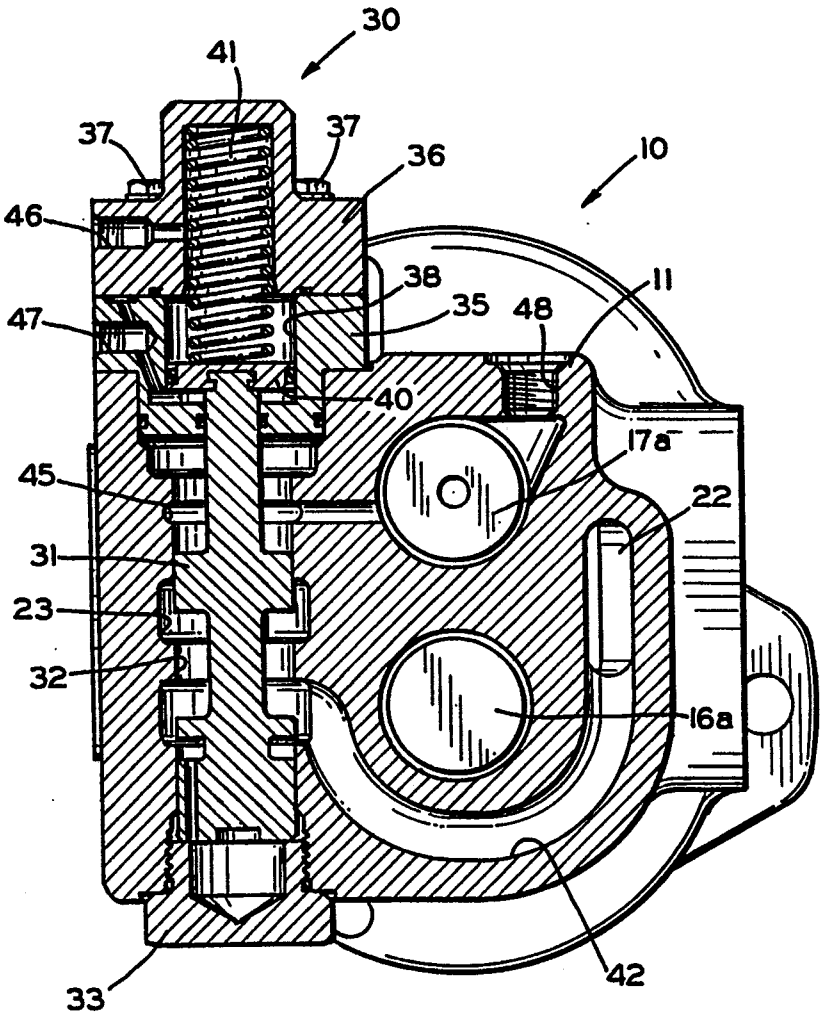
FIG. 5 (PRIOR ART)
FIG. 5 is a sectional elevational view similar to FIG. 3 of a prior art gear pump showing an internal bypass valve in a downward position, whereby the gear pump is operated in a bypass mode.

A prior art gear pump having an internal bypass valve is illustrated in FIG. 5, in which the same reference numerals used with regard to the gear pump of the invention are used to refer to like parts of the prior art gear pump. The prior art gear pump lacks any internal passageway 43 through the spool 31 for providing communication between the outlet port 23 and a case drain port 45 when the spool 31 is in the bypass position. The prior art gear pump shown in FIG. 5 is therefore susceptible to the build-up of heat in the pump during operation in the bypass mode as discussed above.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A pump for selectively generating a flow of fluid from a reservoir to a hydraulically actuated device comprising:

a housing;

an inlet port formed in said housing, said inlet port adapted to communicate with the reservoir;

an outlet port formed in said housing, said outlet port adapted to communicate with the device;

a pumping chamber defined within said housing, said pumping chamber communicating with said inlet port and said outlet port;

pumping means disposed in said pumping chamber for drawing fluid through said inlet port from the reservoir and to generate a flow of fluid from said outlet port to the device; and bypass valve means disposed within said housing and operable in a bypass mode to provide communication between said inlet port and said outlet port, whereby the flow of fluid to the device is prevented to prevent the operation thereof, and operable in an active mode to prevent communication between said outlet port and said inlet port, whereby the flow of fluid to the device is permitted to permit the operation thereof;

said bypass valve means including a drain port formed in said housing adapted to communicate with the reservoir, a spool disposed in a chamber formed in said housing, said spool being movable between bypass and active positions so as to operate said bypass valve means in said bypass and active modes, and an internal passageway formed in said spool, said internal passageway permitting communication between said chamber and said drain port when said spool is in said bypass position and preventing communication between said chamber and said drain port when said spool is in said active position.

2. The invention defined in claim 1 wherein said bypass valve means further includes means for moving said spool between said bypass and active positions.

3. The invention defined in claim 1 wherein said bypass valve means further includes a bypass passageway formed in said housing extending from said chamber to said inlet port, said spool permitting communication between said chamber and said bypass passageway when located in said bypass position and preventing communication between said chamber and said bypass passageway when located in said active position.

4. The invention defined in claim 2 wherein said bypass passageway is substantially larger than said internal passageway.

5. The invention defined in claim 2 wherein said bypass valve means further includes means for moving said spool between said bypass and active positions.

* * * * *

UNITED STATES PATENT AND TRADEMARK OFFICE

CERTIFICATE OF CORRECTION

PATENT NO. : 5,338,161

DATED : August 16, 1994

INVENTOR(S) : James M. Eley

It is certified that error appears in the above-identified patent and that said Letters Patent is hereby corrected as shown below:

Column 8, Claim 4, line 1, after "claim", change "2" to -- 3 --.

Column 8, Claim 5, line 1, after "claim", change "2" to -- 3 --.

Signed and Sealed this

Eighteenth Day of October, 1994

*Attest:*

*Attesting Officer*

Bruce Lehman

BRUCE LEHMAN

*Commissioner of Patents and Trademarks*